US005785217A

United States Patent [19]

Gorham, Jr.

[11] Patent Number: 5,785,217

[45] Date of Patent: Jul. 28, 1998

[54] WRIST-WEAR ATTACHMENT DEVICE AND METHOD OF USE

[76] Inventor: William E. Gorham, Jr., 1313 N. Market St., #3410, Wilmington, Del. 19801-1511

[21] Appl. No.: 800,065

[22] Filed: Feb. 14, 1997

Related U.S. Application Data

[60] Provisional application No. 60/018,796 May 31, 1996.

[51] Int. Cl.[6] ..... A47G 25/80

[52] U.S. Cl. ..... 223/111

[58] Field of Search ..... 223/111; 2/161.4, 2/160, 917, 910, 162, 170

[56] References Cited

U.S. PATENT DOCUMENTS

| | | | |
|---|---|---|---|
| D. 323,132 | 1/1992 | Grennan . | |
| D. 348,187 | 6/1994 | Higgins . | |
| 2,896,890 | 7/1959 | Hlavac . | |
| 3,016,589 | 1/1962 | Collins . | |
| 3,242,540 | 3/1966 | Mitchell . | |
| 3,369,258 | 2/1968 | Smith | 2/159 |
| 4,650,141 | 3/1987 | Longo et al. . | |
| 4,734,973 | 4/1988 | Longo et al. . | |
| 4,958,384 | 9/1990 | McCrane | 2/917 |
| 5,313,667 | 5/1994 | Levine | 2/160 |
| 5,335,916 | 8/1994 | Nee | 2/161.4 |
| 5,405,066 | 4/1995 | Fakier . | |

FOREIGN PATENT DOCUMENTS

| | | |
|---|---|---|
| 52-83460 | 1/1977 | Japan . |
| 222784 | 10/1942 | Switzerland . |

*Primary Examiner*—Bibhu Mohanty
*Attorney, Agent, or Firm*—Richard C. Litman

[57] ABSTRACT

A wrist-wear attachment device for attaching wrist-wear to a wrist and a method for its use. The device allows a user to retain one end of an article of wrist-wear firmly against the wrist, whereby the user may use the other hand to connect the free end of the wrist-wear to the one end retained against the wrist. The device comprises a hand receiving member having one or more apertures through which a user may insert one or more of their fingers, respectively; a strap depending from the hand receiving member for retaining one end of the article of wrist-wear; and fasteners for removably connecting the free end of the strap to the hand receiving member. The method of using wrist-wear attachment devices of the present invention includes: retaining one end of the wrist-wear with the strap; inserting the finger(s) of one hand through the aperture(s) formed in the hand receiving member and placing the hand receiving member onto the hand; passing the other end of the wrist-wear around the wrist until the other end meets the retained end; and connecting the ends of the wrist-wear together with the other hand. Once the ends of the article of wrist-wear are connected, the user may unfold the strap and remove the device from the hand.

6 Claims, 4 Drawing Sheets

WRIST-WEAR ATTACHMENT DEVICE AND METHOD OF USE

CROSS REFERENCE TO RELATED APPLICATIONS

This application claims the benefit of U.S. Provisional application Ser. No. 60/018,796 filed on May 31, 1996.

BACKGROUND OF THE INVENTION

1. Field of the Invention

The present invention relates generally to a device useful for assisting in the attachment of wrist-wear to one's wrist. More specifically, the present invention relates to a device useful for assisting in single-handed attachment about the wrist of wrist-wear, namely watchbands and jewelry of the type having connectable ends. The present invention also relates to a method of using a device according to the present invention.

2. Description of the Prior Art

Single handedly holding an article of jewelry or a watchband around one's wrist while connecting the clasp or buckle is a tricky maneuver for even the most dexterous. Flexible chain and mesh type wrist bracelets are particularly difficult to fasten because their free ends tend to slip off the wrist unless they are held in place. For most persons, it is difficult to hold the bracelet or watchband on the wrist with one hand, and at the same time and with the same hand, clasp or buckle together the free ends. For those who lack the motor coordination (i.e., arthritis sufferers, the elderly, and young children), placing a bracelet or watchband around the wrist and holding the free ends together with one hand, all while attempting to connect the free ends, can be an insurmountably difficult task.

Devices to assist a user in fastening jewelry or watchbands around the wrist are well known in the prior art. For example, U.S. Pat. No. Des. 323,132 issued to Grennan on Jan. 14, 1992, discloses the design for a bracelet fastening tool that appears to have a rigid base, a clamp, and a magnifying lens. The device shown in Grennan is particularly disposed to be placed upon a substantially flat surface (i.e., a table top) prior to its use. Furthermore, the device is not easily carried in a suitcase, a purse, or a pocket.

Several U.S. patents also describe rigid structures having bases, arms and various clasping features. For example, U.S. Pat. No. 2,896,890 issued to Hlavac on Jul. 28, 1959, discloses a bracelet attaching device that has a rigid base, an arm, and a pivoting fork. The pivoting fork limits the application of the device to jewelry having some sort of feature, such as a loop, that can be received by the tine. The device is not readily adapted for use with a finely woven gold chain such as, for example, a fine golden filigree bracelet that does not have loops or buckles. Similarly, U.S. Pat. No. 3,016,589 issued to Clip on May 9, 1960, discloses a device that also includes a hooking feature for holding jewelry. The hooking feature can be only employed with jewelry having loops or some other similar feature that can be received by a tine or a hook.

Other utility patents also describe devices with rigid non-collapsible bases. For instance, U.S. Pat. Nos. 4,650,141 issued to Longo et al. on Mar. 17, 1987; and 4,734,973 issued to Longo et al. on Apr. 5, 1988, disclose a device and a method of use, respectively, for assisting the attachment of a bracelet. Both patents describe a device that has a sturdy base, an upwardly extending arm with an alligator clip attached thereon. The device described in the Longo patents must be supported on a table or other suitable stable surface when employed. Similarly, U.S. Pat. No. 5,405,006 issued to Fakler on Apr. 11, 1995, describes a device for helping attach a bracelet, yet the device must be mounted on the edge of a planar surface to be employed.

Of particular interest to the present invention is U.S. Pat. No. 3,242,540 issued to Mitchell on Jan. 30, 1964, which discloses a wire structure with a finger receiving ring and a hook attached thereon. Although the function is conceptually similar to the present invention, it can only be used with jewelry that has an annular structure through which the hook member may be received. Furthermore, the device described in Mitchell is rigid and requires a degree of manual dexterity and flexibility. For instance, those persons suffering from arthritis would not be able firmly to grip the device while attempting to attach the clasp of a bracelet. Also seemingly similar in function to the present invention is U.S. Pat. No. Des. 348,187 issued to Higgins on Jun. 28, 1994, which discloses the ornamental design for a bracelet fastening tool, apparently having a rigid disk with an extending hook. The manner of use, however, is difficult to ascertain and understand.

Two foreign patents describe devices that are only indirectly pertinent to the present invention: Japanese Pat. No. 52-8340 issued on January, 1977, describes a glove device; and Swiss Pat. No. 222,784 issued on Oct. 16, 1942 to Christen-Hausmann discloses a wrap-around wrist warmer made of fur. The present invention does not concern a glove or an article of personal adornment.

Though various apparatus have been devised to assist attaching wrist jewelry about the wrist, none are easily portable and highly convenient. Related devices described in patents are often rigid structural devices with bases, arms, and clamping features that restrict portability of the device for both the traveler and persons who move about during their daily schedule. Other devices described in related arts have features for securing jewelry which are not well adapted for use with a broad range of different types of wrist jewelry and watchbands. Therefore, there is a need for a device to assist in the attachment of any type of wrist jewelry and watchbands, whereby the device is easily portable for storage in a pocket, purse or briefcase, and quite simple to use, particularly by persons having impaired-use hands.

None of the above inventions and patents, taken either singly or in combination, is seen to describe the instant invention as claimed.

SUMMARY OF THE INVENTION

Accordingly, it is a principal object of the invention to provide a wrist-wear attachment device that assists single-handed placement of wrist-wear on the wrist.

It is also an object of the invention to provide a wrist-wear attachment device that is light weight, portable, and hand-held.

Another object of the invention is to provide a wrist-wear attachment device which is simple and convenient to use by all persons, including those who have impaired-use hands.

Yet another object of the invention is to provide a device for assisting placement of wrist-wear on the wrist which is capable of accommodating a broad range of different types of wrist jewelry and watchbands.

Another object of the invention is to provide a method of attaching wrist-wear around the wrist using a wrist-wear attachment device according to the present invention.

In accordance with the objects of the present invention, the various embodiments of the wrist-wear attachment device allow a user to retain one end of a piece of wrist-wear (an article of jewelry or a watchband) firmly against his or her wrist, whereby the user may use the other hand to connect the free end of the wrist-wear to the one end retained against the wrist. The present invention is a hand held device made from a light weight flexible material, which renders the device readily portable upon folding for storage in a pocket, purse, or other carrying bag. The device comprises a hand receiving member having one or more apertures through which a user may insert one or more fingers; a strap depending from the hand receiving member for retaining one end of an article of wrist-wear; and a fastener for removably connecting the free end of the strap to the hand receiving member. Mating fasteners, preferably VELCRO (hook and loop type fasteners), are located at the free end of the strap and either on the hand receiving member or at the secured end of the strap. The fasteners are positioned to mate when the strap is folded over onto the hand receiving member (or itself, depending upon where the fasteners are located). When folded, the strap retains one end of the wrist-wear against the wrist of the wearer while the hand receiving member receives a portion of the hand.

The method of using the wrist-wear attachment devices of the present invention includes: retaining one end of the wrist-wear with the strap; inserting the finger(s) of one hand through the aperture(s) formed in the hand receiving member and placing the hand receiving member onto the hand; passing the other end of the wrist-wear around the wrist until the other end meets the retained end; and connecting the ends of the wrist-wear together with the other hand. Once the ends of the article of wrist-wear are connected, the user may unfold the strap and remove the device from the hand.

It is also an object of the invention to provide improved elements and arrangements thereof in a wrist-wear attachment device for the purposes described which is inexpensive, dependable and fully effective in accomplishing its intended purposes.

These and other objects of the wrist-wear attachment device will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is disposed to be used for the purpose of attaching a broad range of different styles of wrist-wear about the wrist. A device according to the present invention is disposed to be used in connection with a variety of wrist-wear of the type having connectable ends, such as watchbands with buckles and jewelry with various clasping mechanisms. The present invention is not to be limited in scope by the type of wrist-wear with which it may be used.

Figure 1:
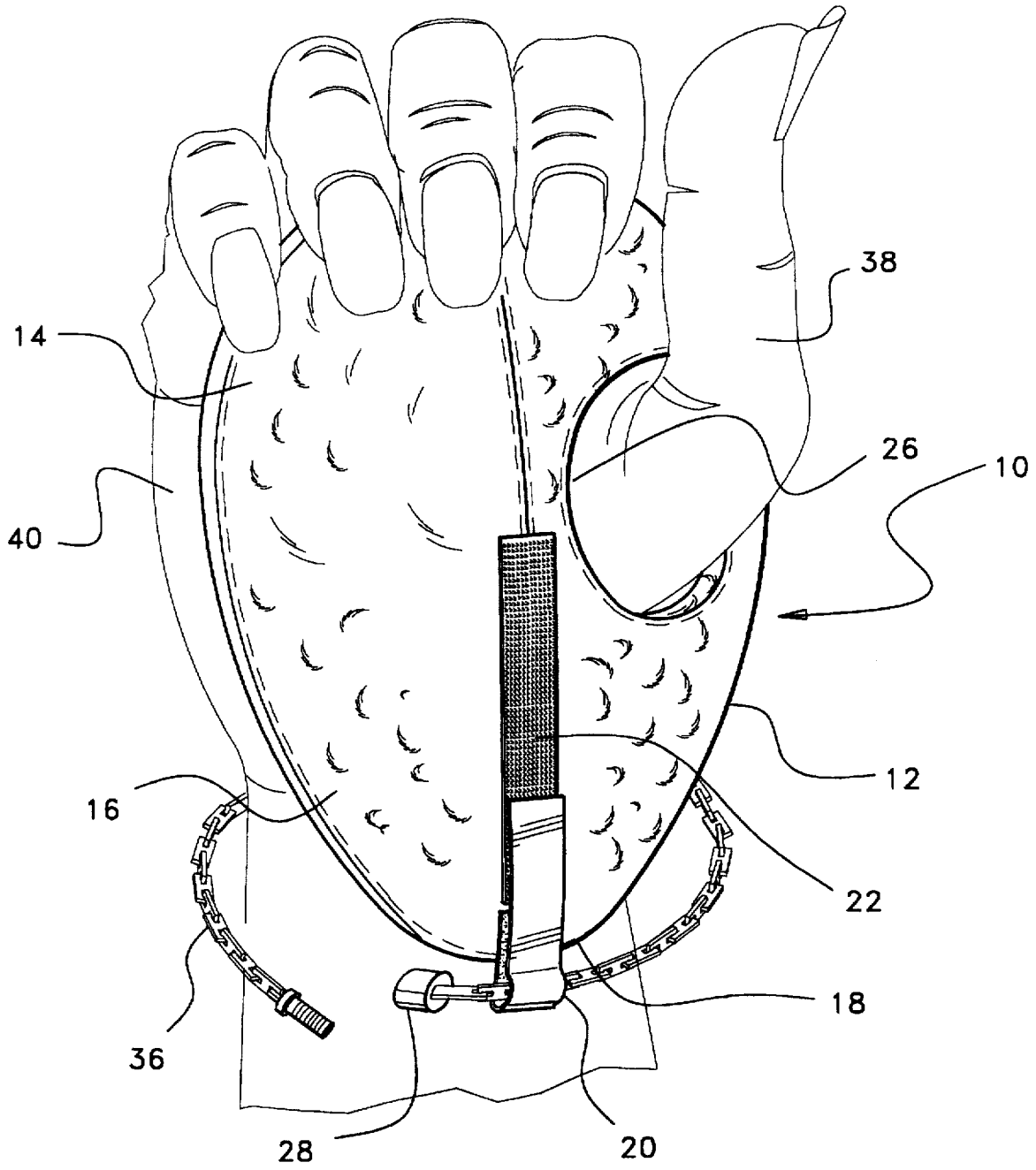
FIG. 1 is an environmental perspective view of a first embodiment of the attachment device of the present invention which shows a bracelet being attached to the wrist.
Figure 2:
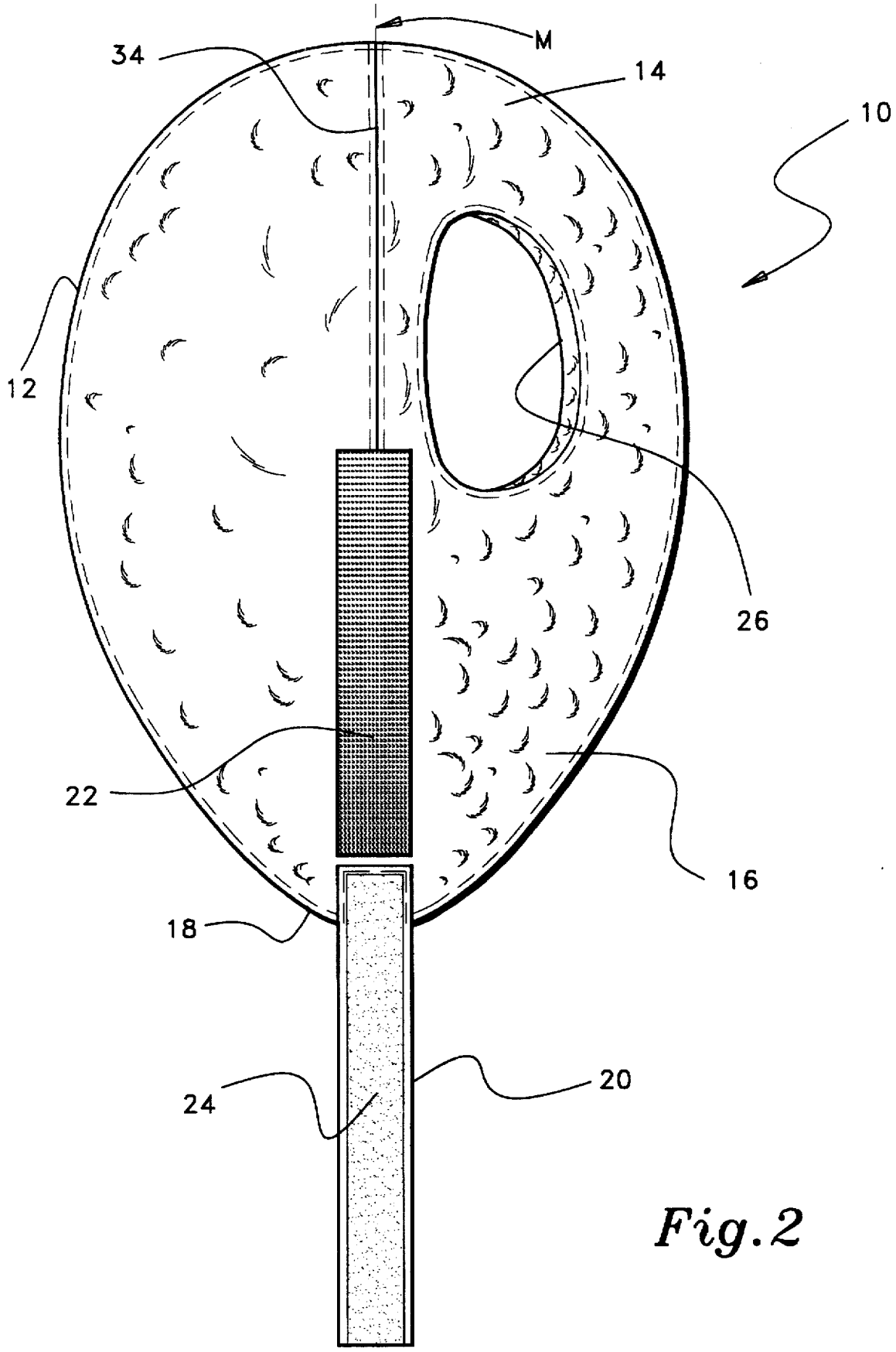
FIG. 2 is a top plan view of the first embodiment of the device.

Referring now to the drawings by numerals of reference and first to FIGS. 1 and 2, a wrist-wear attachment device 10 is shown, constructed according to a first embodiment of the invention. Attachment device 10 generally comprises a hand receiving member 12 and a strap 20 depending from the hand receiving member. Preferably the hand receiving member 12 is formed of a flexible web made of a material such as, for example, neoprene, fleece, or other woven and/or non-woven fabrics formed from natural and/or synthetic materials. While the hand receiving member 12 may be formed of a single piece of the flexible material, one or more pieces of the flexible material also may be joined together, by sewn stitching or the like, in any convenient shape or form. The hand receiving member 12 is formed of two separate pieces of the flexible material which are sewn together along a seam 34. The seam may be used to cause cupping of the hand receiving member 12 so that it more comfortably fits the hand. As shown in FIG. 2, the seam 34 approximates a midline M along the length of the hand receiving member.

As shown in FIG. 1, the hand receiving member 12 has a substantially ellipsoidal shape, and is disposed to fit into the palm of the hand. The hand receiving member 12 includes a palm accommodating portion 14 and an integral wrist accommodating portion 16. A single aperture 26 is formed into the palm accommodating portion 14 and is disposed to receive a finger of the hand upon which the device is placed. As shown in FIG. 1, the aperture 26 receives the thumb. As discussed more fully hereinafter, the thumb may be used to grip the hand receiving member 12 while the attachment 10 is placed onto the hand.

Secured to the wrist accommodating portion 16 is the strap 20. The strap may be entirely flexible, or it also may be substantially rigid with a flexible portion that allows the strap to fold onto itself, as discussed hereinafter. The strap 20 shown in FIGS. 1 and 2 is preferably of the type which is flexible along its entire length. The strap 20 functions to retain one end of an article of wrist-wear against the wrist while the hand receiving member receives the hand. To accomplish this, the strap 20 is provided with means for fastening one end of the strap to the hand receiving member or to the other end of the strap. As shown in FIG. 2, the strap 20 is provided with a first fastener 24 which is constructed from one of a hook type fastening material or a loop type fastening material. Secured to the hand receiving member 12 is a second fastener 22 which is constructed from the other of a hook type fastening material or a loop type fastening material. The second fastener 22 is positioned to contact the first fastener 24 when the strap is folded onto the hand receiving member, as shown in FIG. 1. In the alternative, the second fastener may be positioned on the end of the strap which is secured to the hand receiving member 12, thus allowing the opposite ends of the strap to become fastened.

To use the attachment device 10, a user should first select the wrist-wear which he or she would like to place about his or her wrist. As shown in FIG. 1, a bracelet 36 may be selected. To begin, the user will lay one end of the bracelet 36 across the strap 20 adjacent to the lower edge 18 of the wrist accommodating portion 16. The user will then fold the strap 20 onto the wrist accommodating portion 16 so that the first and second fasteners 24,22 contact one another to retain the one end of the bracelet, as shown in FIG. 1. With the one end of the bracelet retained, the user will place the hand receiving member 12 onto his or her hand by inserting the thumb 38 through the aperture 26. With his or her thumb fully inserted through the aperture 26, the hand receiving member will rest against the palm 40 of the hand with wrist accommodating portion overlaying wrist. In this position, the strap 20 maintains the one end of the bracelet 36 against the wrist. If desired, the user may grip the hand receiving member 12 with use of his or her thumb 38. The user will then grasp the other end (or free end) of the bracelet 36 with the other hand, and proceed to wrap the bracelet 36 around the wrist to bring the two ends of the bracelet together. With the ends together, the user will clasp the ends of the bracelet together with the other hand by using the clasp mechanism 28 provided on the ends of the bracelet. With the bracelet 36 clasped about the wrist, the user will unfold strap 20 to free the bracelet 36, and then remove the hand receiving member from the hand. As the hand receiving member is pulled away from the hand, the strap 20 is withdrawn from its position beneath the bracelet.

It should be noted that the one end of the wrist-wear also may be retained by the strap following placement of the hand receiving member onto the hand. This may be difficult to accomplish for persons whose use of the hands is impaired, because it would require the person to hold the one end of the wrist-wear over the strap with the other hand and then fold the strap with the same hand in order to retain the one end of the wrist-wear against the wrist.

Figure 3:
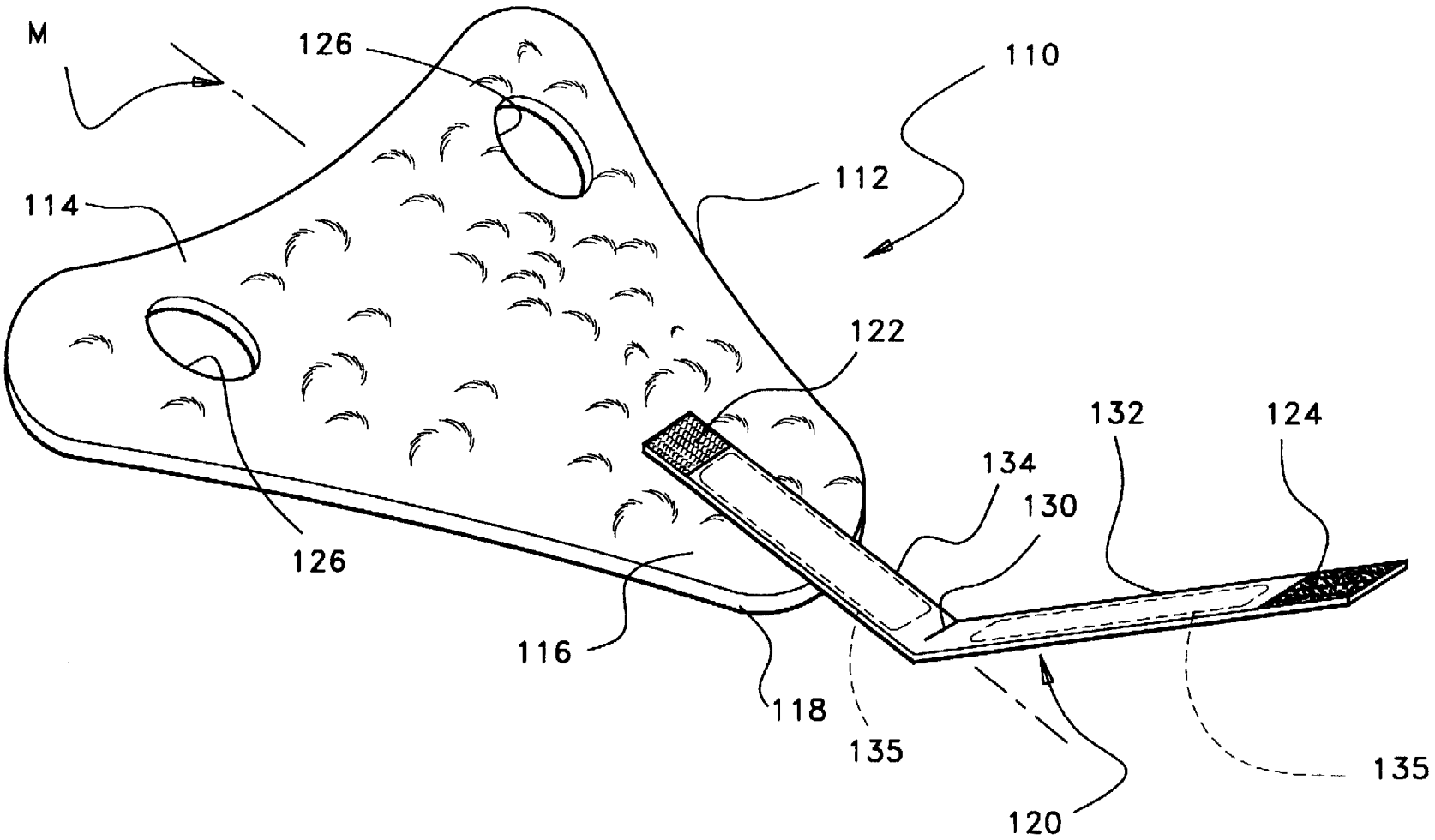
FIG. 3 is a perspective view of a second embodiment of the attachment device of the present invention.
Figure 4:
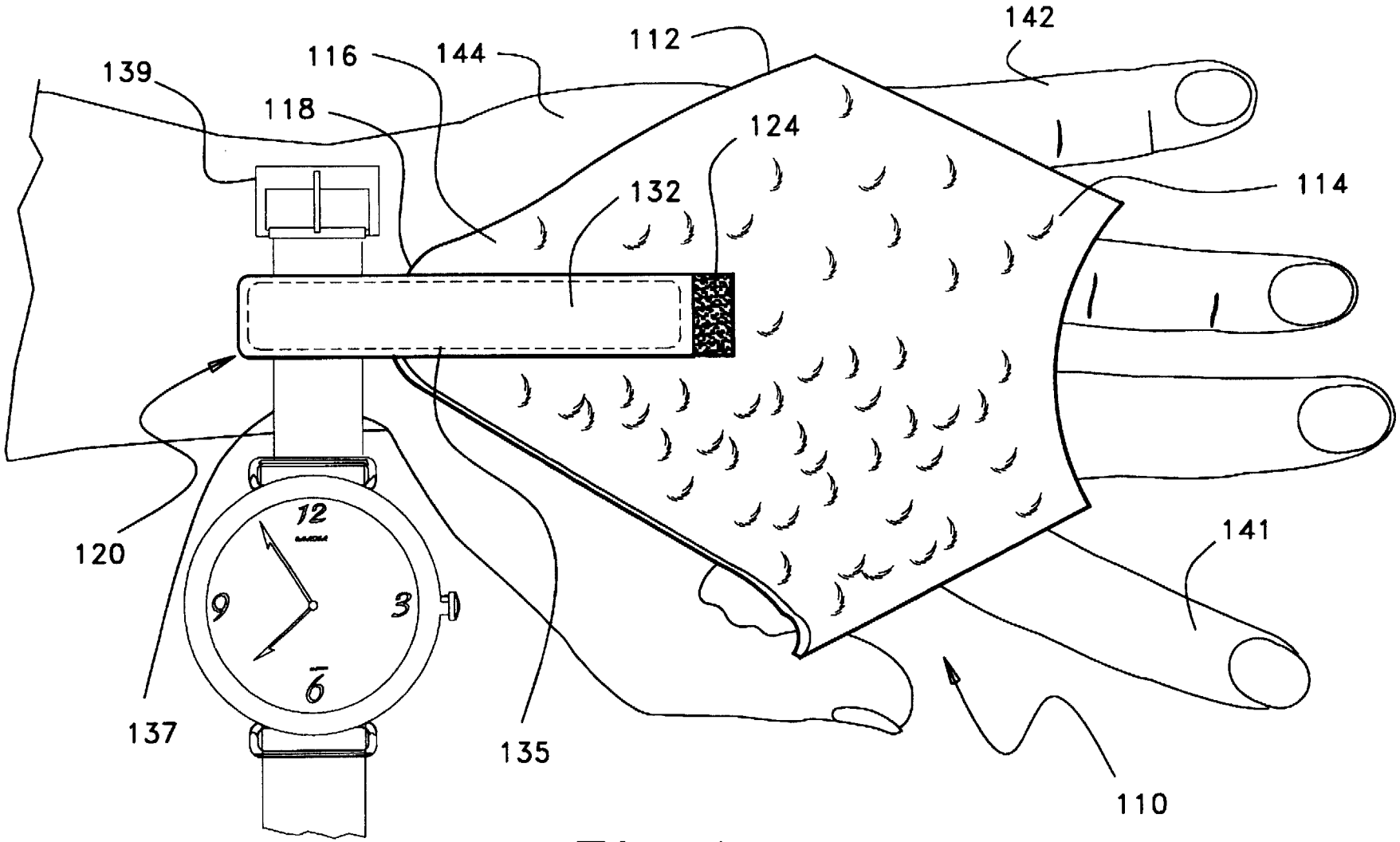
FIG. 4 is an environmental perspective view of the second embodiment of the device which shows a watchband being attached to the wrist.

Referring now FIGS. 3 and 4, a wrist-wear attachment device 110 constructed according to a second embodiment of the invention is shown. The attachment device 110 generally comprises a hand receiving member 112 and a strap 120 depending from the hand receiving member. The hand receiving member 112 is preferably formed of a flexible web of material of the type disclosed herein with respect to the hand receiving member 12. As before, the hand receiving member 112 may be formed of a single piece of the flexible material, or one or more pieces of flexible material may be sewn together in any convenient shape or form.

The hand receiving member 112 is shown in FIG. 3 to have a substantially triangular configuration with a midline M along its length. With its triangular shape, the hand receiving member 112 is particularly disposed to fit over the back of the hand. The hand receiving member 112 includes a knuckle accommodating portion 114 and an integral wrist accommodating portion 116. Into the knuckle accommodating portion is formed a pair of apertures 126, each of which is disposed to receive a separate finger of the hand upon which the device is placed. The apertures 126 are substantially equispaced from the midline M, whereby the apertures are disposed to receive the first and fourth fingers (i.e. index and pinky fingers), respectively. It should be noted, however, that the apertures may be spaced in different configurations to allow for use with other finger combinations.

Secured to the wrist accommodating portion 116 is the strap 120. As before, the strap may be entirely flexible or it also may be substantially rigid with a flexible portion that allows the strap to fold onto itself, as discussed hereinafter. The strap 120 shown in FIGS. 3 and 4 is preferably of the latter type, having a flexible portion 130 intermediate a first rigid portion 132 and a second rigid portion 134. The strap is formed from a sleeve of material and each of the rigid portions 132,134 is provided with rigid element 135 (i.e., a thin strip or band of rigid material) fixed in the sleeve of material by any conventional means. The strap 120 functions as the means for retaining one end of an article of wrist-wear against the wrist while the hand receiving member receives the hand. To accomplish this desired function, the strap 120 is provided with means for fastening one end of the strap to the other end of the strap. As shown in FIG. 3, the end of strap 120 containing the first rigid portion 132 is provided with a first fastener 124 and the opposite end of the strap is provided with a second fastener 122. The first and second fasteners 122,124 preferably are constructed from hook and loop type fastening material, wherein one of the fasteners is of the hook type and the other fastener is of the loop type. The second fastener 122 is positioned to contact the first fastener 124 when the strap 120 is folded onto itself, as shown in FIG. 4. In the alternative, the second fastener may be positioned on the hand receiving member 112.

To use the attachment device 110, a user should first select the wrist-wear which he or she would like to place about his or her wrist. As shown in FIG. 4, a watch with a watchband 137 may be selected. To begin, the user should lay one end of the watchband 137 across the strap 120 adjacent to the lower edge 118 of the wrist accommodating portion 116. The user should then fold the strap 120 onto itself (and the wrist accommodating portion 116) so that the first and second fasteners 124,122 contact one another to retain the one end of the watchband, as shown in FIG. 4. Ideally, the end of the watchband 137 which contains a buckle 139 or the like should be retained by the strap 120. With the one end of the watchband 137 retained, the user should place the hand receiving member 112 onto his or her hand by inserting the first or index finger 141 and pinky finger 142 through the apertures 126. With his or her fingers fully inserted through the apertures 126, the hand receiving member 112 should rest against the back 144 of the hand with the wrist accommodating portion overlaying wrist. In this position, the strap 120 maintains the one end of the watchband 137 against the wrist. The user should then grasp the other end (or free end) of the watchband with the other hand, and proceed to wrap the watchband 137 around the wrist to bring the two ends of the watchband together. With the ends together, the user should connect the ends of the watchband together with the other hand by inserting the free end of the watchband through the buckle 139 in a conventional manner. Where an alternative fastener is used for connecting the ends of the watchband, such alternative fasteners should be used in a conventional manner. With the watchband 137 attached about the wrist, the user should unfold strap 120 to free the watchband 137, and then remove the hand receiving member from their hand. As the hand receiving member is pulled away from the hand, the strap 120 is withdrawn from its position beneath the watchband.

It is to be understood that the present invention is not limited to the embodiments described above, but encompasses any and all embodiments within the scope of the following claims.

I claim:

1. A wrist-wear attachment device for facilitating the attachment of wrist-wear having connectable ends, the attachment device comprising:

a hand receiving member formed of a flexible web of material, said hand receiving member having a midline and a first aperture for receiving a finger, said first aperture being displaced from the midline of said hand receiving member;

a strap extending along the midline of said hand receiving member, said strap having a first end secured to a portion of said hand receiving member, a second end, a first rigid portion adjacent said first end, a second rigid portion adjacent said second end, and a flexible portion intermediate said first rigid portion and said second rigid portion; and fastening means for removably fastening said second end of said strap to said hand receiving member; whereby said strap is foldable at said flexible portion to retain one end of the wrist-wear between said first rigid portion and said second rigid portion.

2. The wrist-wear attachment device according to claim 1, wherein said hand receiving member has a second aperture formed therein for receiving another finger of the hand, said second aperture being displaced from said midline of said hand receiving member.

3. The wrist-wear attachment device according to claim 2, wherein said first and second apertures are displaced equally from a midline of the hand receiving member.

4. The wrist-wear attachment device according to claim 1, wherein said fastening means removably fasten the second end of said strap to said first end of said strap which is secured to said hand receiving member.

5. The wrist-wear attachment device according to claim 1, wherein said strap comprises a sleeve of material, said first rigid portion having a first rigid element secured with in said sleeve of material, and said second rigid portion having a second rigid element secured with said sleeve of material.

6. The wrist-wear attachment device according to claim 1, wherein said fastening means comprise:

a first fastener attached to said first end of said strap; and a second fastener attached to said second end of said strap;

wherein one of said fasteners is a hook type fastener and the other of said fasteners is a loop type fastener, said first fastener being aligned to contact said second fastener when said second end of said strap is folded onto said hand receiving member.

* * * * *